United States Patent [19]

Odum

[11] Patent Number: 4,501,238

[45] Date of Patent: Feb. 26, 1985

[54] ENGINE AIR INTAKE SHUT-OFF VALVE

[76] Inventor: Charles E. Odum, 1616 W. Belt N., Houston, Tex. 77043

[21] Appl. No.: 491,032

[22] Filed: May 3, 1983

[51] Int. Cl.[3] ..... F02B 77/08

[52] U.S. Cl. ..... 123/198 D; 123/323; 251/175

[58] Field of Search ..... 123/198 D, 198 DB, 323; 251/175, 199

[56] References Cited

U.S. PATENT DOCUMENTS

| | | | |
|---|---|---|---|
| 1,200,170 | 11/1916 | Collins . | |
| 2,884,222 | 4/1959 | Oakes | 251/73 |
| 2,973,009 | 2/1961 | Kazyaka | 137/554 |
| 3,172,193 | 3/1965 | Grove | 29/157.1 |
| 3,202,161 | 8/1965 | Richards | 123/198 D |
| 3,244,399 | 4/1966 | Jones et al. | 251/327 |
| 3,378,224 | 4/1968 | Boyle | 251/14 |
| 3,379,405 | 4/1968 | Natho | 251/31 |
| 3,542,332 | 11/1970 | Chevalier | 251/63.6 |
| 3,927,656 | 12/1975 | Reed et al. | 123/198 D |
| 3,958,592 | 5/1976 | Wells et al. | 137/315 |
| 4,054,156 | 10/1977 | Benson | 137/630.12 |
| 4,153,069 | 5/1979 | Frechou et al. | 137/238 |
| 4,215,845 | 8/1980 | Sturgeon | 251/63 |
| 4,285,494 | 8/1981 | Sturgeon | 251/63 |
| 4,294,284 | 10/1981 | Herd | 137/613 |
| 4,335,733 | 6/1982 | Richards | 137/1 |
| 4,422,418 | 12/1983 | Dorn | 123/198 DB |

OTHER PUBLICATIONS

Advertisement from May, 1982 issue of Diesel Progress North American magazine.

*Primary Examiner*—Ira S. Lazarus

*Attorney, Agent, or Firm*—Arnold, White & Durkee

[57] ABSTRACT

An engine air intake shut-off valve utilizing a loose-fitting gate member is disclosed. The shut-off valve is of the sliding gate type in which a gate member is reciprocable between an open and a closed position. The gate member is dimensioned smaller than the interior of the valve housing to provide a clearance for smooth operation after dirt has accumulated in the housing. The gate member is loosely connected to a reciprocating cylinder which permits the gate member to move along the direction of air flow to seat against either of two opposed seating surfaces in the valve housing.

7 Claims, 4 Drawing Figures

ENGINE AIR INTAKE SHUT-OFF VALVE

BACKGROUND OF THE INVENTION

This invention relates to engine air intake shutoff valves. More particularly, this invention concerns a gate valve having a loose-fitting gate member that can seat against one seating surface to restrict air flow into a combustion engine or an opposed seating surface to contain an intake manifold explosion.

It is well known to provide an engine air intake shut-off valve between the air induction system and the intake manifold of an internal combustion engine. The primary function of an engine air intake shut-off valve is to protect against two serious engine malfunctions, overspeed and intake manifold explosion.

Engine overspeed may occur when there is a sudden load drop on the engine that permits an abrupt acceleration of the engine. If this occurs, the governor can usually react to regain control of the engine. In its more serious form, overspeed occurs when the engine receives fuel from another source. This most commonly occurs by induction of combustible vapors from the atmosphere. Another source of fuel is the turbo-charger oil seals, or the engine may suck fuel from an oil bath air cleaner. In the worst overspeed situation, the engine may accelerate to total destruction.

Shutting off the main fuel supply has little effect on a serious overspeed condition. The only safe solution is to shut off the air supply to the engine.

The second engine malfunction, intake manifold explosion, is created when combustible vapors have been induced into the intake manifold and are drawn into the cylinder and ignited on the intake stroke by hot spots in the cylinder prior to intake valve closing. An explosion can also occur during engine shutdown if an air intake shut-off valve momentarily pops open, allowing a fresh surge of combustible vapors to be introduced into the combustion chamber where there is a hot, fuel-rich mixture that may explode.

Various air intake shut-off valve designs are currently in use, including butterfly valves, in-line spring loaded valves, and sliding gate valves. Shut-off valves of the sliding gate type are preferred for two reasons. First, unlike butterfly and in-line spring loaded valves, sliding gate valves do not tend to pop open during shutdown, thus reducing the chances of an intake manifold explosion. Second, butterfly valves frequently fail under the pressures created by an intake manifold explosion. Sliding gate valves, by contrast, provide a much more substantial closure of the air intake line which can withstand these high pressures.

The main disadvantage of present sliding gate valves is that they are designed with a gate member that fits snugly between two opposed sealing surfaces in the valve body. Because of this tight fit, dirt can accumulate in the valve which inhibits free movement of the valve to the closed position. Thus, these valve designs require frequent maintenance to maintain valve operability.

Further, present gate valve designs require a positive sealing element such as an O-ring to provide a tight seal between the gate member and the valve housing. These sealing elements can wear and fail over time and must eventually be replaced.

SUMMARY OF THE INVENTION

The engine air intake shut-off valve of the present invention alleviates these disadvantages by providing a gate valve having a gate member which fits loosely in the valve housing and yet which is capable of adequately restricting air flow into the intake manifold to prevent overspeed and containing an intake manifold explosion.

According to one embodiment of the present invention, there is provided a shut-off valve for restricting air flow to or from an engine comprising a housing which defines a cavity therein. The cavity comprises an upper portion and a lower portion. An air passage extends through the housing and is alignable with an engine air intake line. The air passage comprises axially aligned first and second ports extending through opposed sides of the housing and also comprises the lower portion of the cavity. First and second seating surfaces extend around the periphery of the first and second ports, respectively, on the interior of the housing. A gate member resides in the cavity and is reciprocable in the cavity in a direction perpendicular to the aligned axes of the first and second ports from an open position in the upper portion of the cavity to a closed position intermediate the first and second ports in the lower portion of the cavity. The gate member has a dimension along the axis of the air passage smaller than the axial distance between the first and second seating surfaces, and the gate member is seatable against the first or second seating surface. The valve also includes means for reciprocating the gate member into and maintaining the gate member in the open or closed position. Finally, the valve has means for connecting the gate member to the reciprocating and maintaining means, permitting the gate member freedom of movement along the axis of the air passage to the extent of the distance between the first and second seating surfaces.

In another embodiment of the invention, the first and second ports are circular. The gate member comprises a disc having opposed first and second circular surfaces and a substantially cylindrical peripheral surface. The disc has a radius larger than the radius of the first and second ports. The outer periphery of the first and second circular surfaces are seatable against the first and second seating surfaces, respectively.

In a further embodiment of the invention, the housing has a generally semicircular interior lower wall. The housing has a pair of substantially parallel opposed lateral interior walls which extend the length of the cavity from the upper portion to the lower portion, and each lateral wall lies in a plane parallel to the axis of the air passage. Both lateral walls are integral with the semi-circular lower wall, and the distance between the lateral walls is greater than the diameter of the gate member. The housing also has a pair of substantially parallel opposed transverse interior walls which extend the length of the cavity from the upper portion to the lower portion in a plane transverse to the axis of the air passage. A portion of the transverse walls adjacent to the first and second ports comprises the first and second seating surfaces.

It is therefore an advantage of the present invention that the air intake shut-off valve can be used on most types of internal combustion engines of the reciprocating type.

Another advantage of the shut-off valve of the present invention is that it is substantially maintenance free because the loose-fitting gate member permits operation of the valve even after dirt has built up in the valve housing.

A further advantage of the shut-off valve of the present invention is that it is easy to manufacture because no internal machining of the housing is required.

Still another advantage is that the shut-off valve of the present invention does not require lubrication between the housing and the gate member because of the loose fit.

A still further advantage is that the shut-off valve of the present invention eliminates the need for air passage sealing rings that may fail and require replacement.

DETAILED DESCRIPTION OF THE PREFERRED EMBODIMENTS

Figure 2:
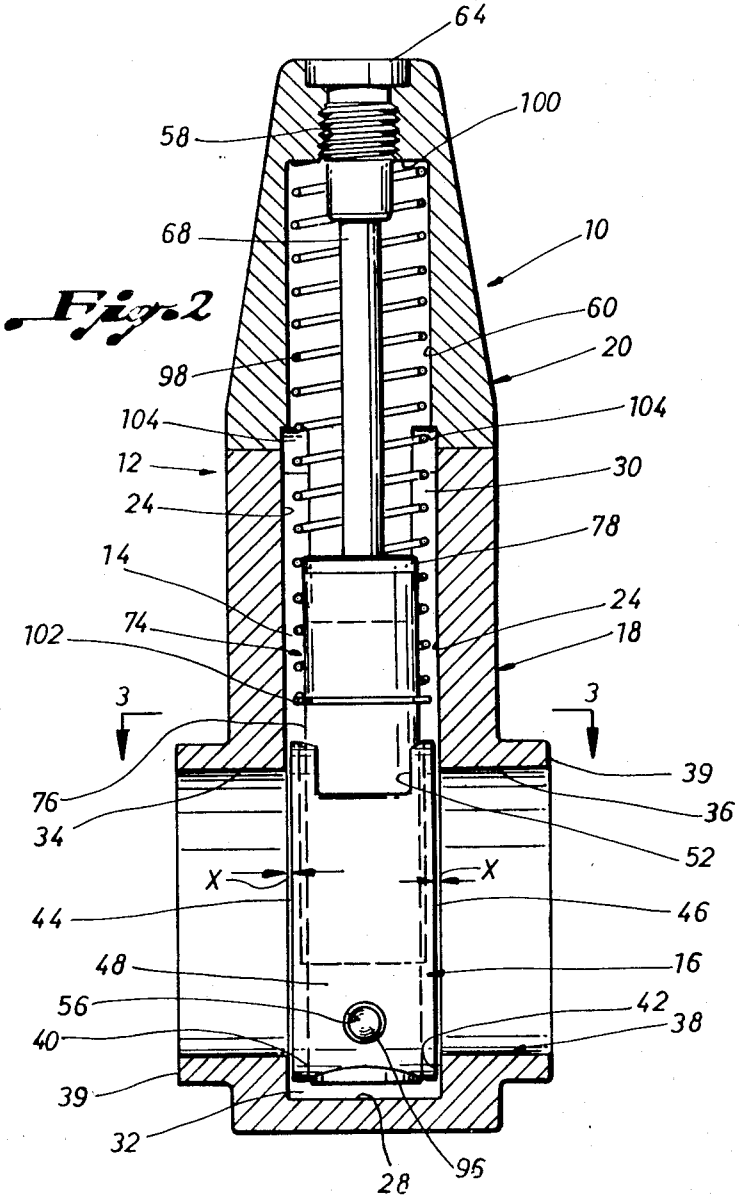
FIG. 2 is a partial side vertical section through the housing of the shut-off valve of the present invention showing the gate member in the closed position.

In the description that follows, similar reference numerals refer to similar elements in all figures of the drawings.

Figure 1:
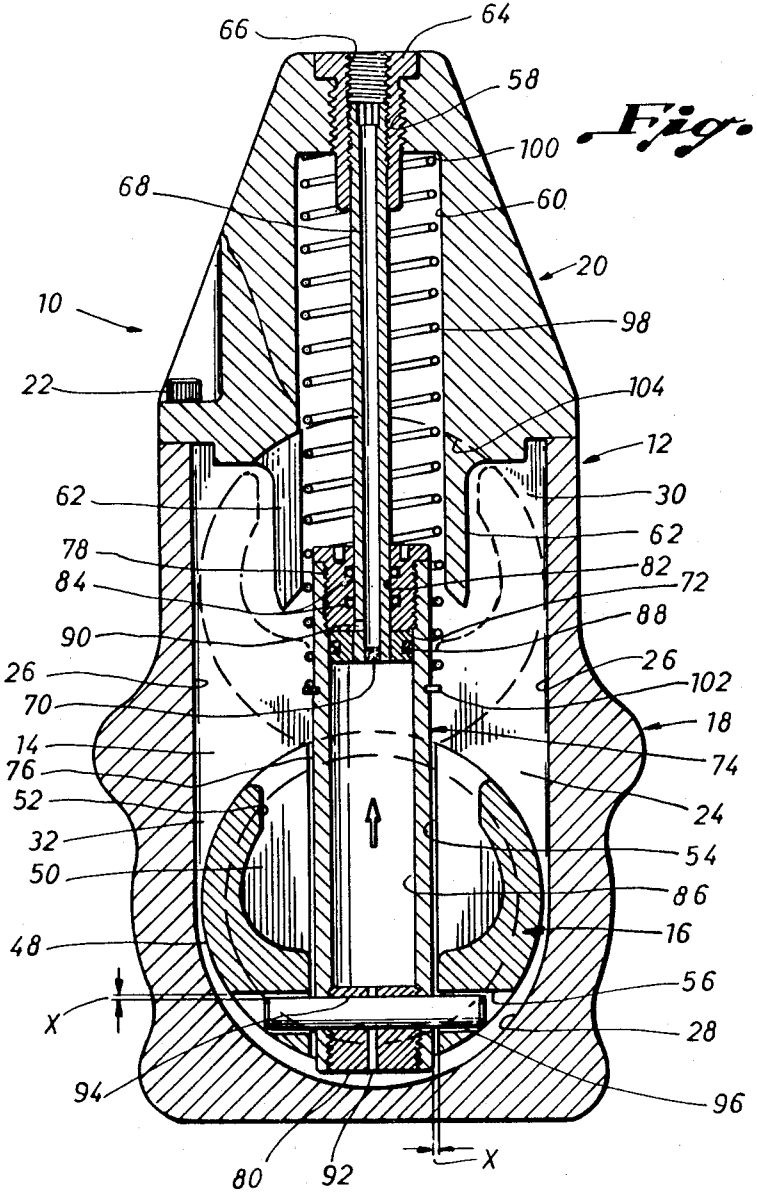
FIG. 1 is a vertical section through the housing of the air intake shut-off valve of the present invention in which the gate member is in the closed position and the open gate position is shown in phantom.
Figure 3:
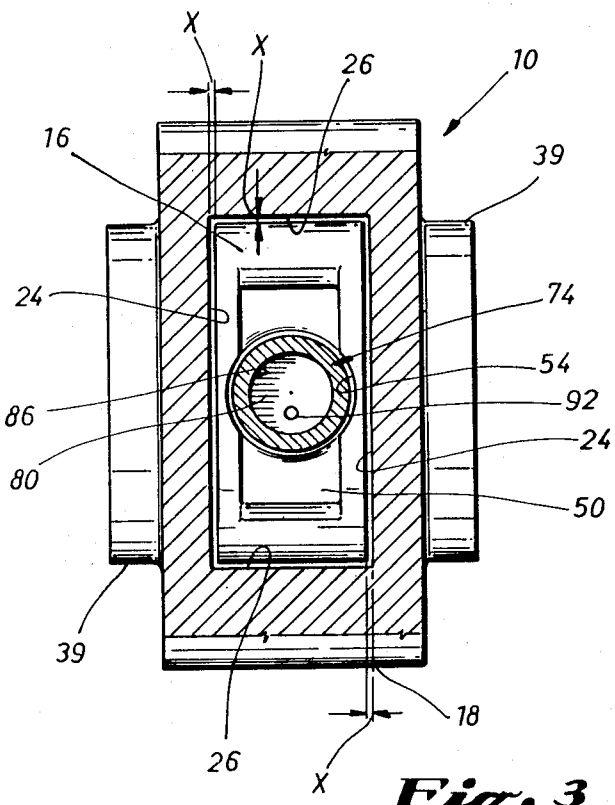
FIG. 3 is a section through the housing of the valve of the present invention taken along line 3—3 of FIG. 2.

One preferred embodiment of the air intake shut-off valve of the present invention is illustrated in FIGS. 1, 2 and 3. Air intake shut-off valve 10 generally comprises a housing 12 which defines a cavity 14 therein and a gate member 16 positioned in the cavity which can be reciprocated between open and closed positions.

Housing 12 is made up of a body 18 in which cavity 14 is defined and a top or cap 20 which closes off the cavity. Top 20 is affixed to body 18 by four suitable bolt fasteners 22 as shown. To provide a seal between body 18 and top 20, either silicon rubber should be applied to the mating surfaces or a gasket interposed therebetween.

As shown, body 18 is preferably generally rectangular in configuration. Body 18 has a pair of opposed interior transverse walls 24 and a pair of opposed interior lateral walls 26. A bottom wall 28 is generally semicircular and integral with lateral walls 26.

Cavity 14 has an upper portion 30 to accommodate gate member 16 in the valve open position and a lower portion 32 to accommodate the gate member in the closed position. Body 18 of housing 12 has a first port 34 extending through one transverse wall 24 and a second port 36 extending through an opposed transverse wall 24 and in axial alignment with first port 34. First port 34, second port 36 and the lower portion 32 of the cavity between the ports together make up an air passage 38 extending through shut-off valve 10. Air passage 38 is alignable with the engine air intake line between the air induction system and the inlet manifold. As shown in FIGS. 2 and 3, body 18 of housing 12 may have nozzles 39 formed thereon adapted to receive a clamp which connects the air intake line to shut-off valve 10. Alternatively, bolt-on flanges may be used to connect the air intake line to the valve.

Ports 34, 36 have a diameter smaller than the diameter of bottom wall 28 and likewise equally smaller than the distance between lateral walls 26. Thus, the portion of each transverse wall 24 immediately adjacent first port 34 and second port 36 provides a first seating surface 40 and a second seating surface 42, respectively.

As shown in FIG. 1, gate 16 in its closed position and likewise ports 34, 36 are not concentric with the radial center of semicircular bottom wall 28. Instead, gate 16 and ports 34, 36 are centered above the radial center of bottom wall 28 so that gate 16 does not touch bottom wall 28 upon closure of the valve, thus preventing wear on the gate and bottom wall. The bottom wall is preferably semicircular, however, so that the wall follows the contour of gate member 16, thereby minimizing the gap between the gate and bottom wall for reasons which will be explained more fully below.

Gate member 16 is in the form of a disc having a first circular face 44, a second circular face 46, and a cylindrical peripheral surface 48. Gate 16 has a cavity 50 therein extending downwardly from a mouth 52. Gate cavity 50 further has a central cylinder receiving bore 54 extending vertically therethrough. A dowel pin receiving passage 56 transversely communicates with the lower end of bore 54. The various components are dimensioned so that there is a clearance "x" between the housing walls and the gate member, the amount and purpose of which will subsequently be discussed.

Top 20 has an internally threaded aperture 58 extending downwardly from its upper side. A larger reciprocation bore 60 extends from aperture 58 into upper portion 30 of the cavity. A pair of spring guide fingers 62 project downwardly from the lower side of top 20 into cavity 14.

A top insert 64 is threaded into aperture 58 and has a passage extending therethrough. This passage has an internally threaded upper portion 66 to receive a threaded connection from a pressurized fluid source (not shown).

A hollow rod 68 threads into a lower portion of top insert 64 and depends downwardly therefrom in reciprocation bore 60. Rod 68 communicates with the pressurized fluid source through the passage in top insert 64. Rod 68 is closed off at its lower extreme by a plug 70. A piston 72 is mounted at the lower extreme of rod 68, preferably by silver soldering.

A cylinder 74 slidably engages rod 68. Cylinder 74 is made up of a cylinder barrel 76, a cylinder gland 78 threaded into the upper end of the cylinder barrel, and a bottom plug 80 threaded into the bottom of the cylinder barrel. The lower portion of cylinder barrel 76 extends through central cylinder receiving bore 54 of gate 16. Cylinder gland 78 has a central rod receiving bore 82 extending therethrough that slidably engages rod 68. A pair of O-rings 84 provide a fluid-tight seal between the rod and bore. An interior wall 86 of cylinder barrel 76 slidably engages piston 72. U-packing 88 provides a fluid-tight seal between the piston and interior wall. An aperture 90 just above piston 72 communicates between the interior of rod 68 and cylinder 74.

Bottom plug 80 of cylinder 74 preferably has a pair of opposed apertures extending into the bottom plug from the lower side thereof. Apertures 92 are positioned on opposed sides of the axis of bottom plug 80 for receiving a spanner wrench. One of these apertures preferably extends through bottom plug 80 and into the interior of cylinder 74 to act as an air inlet and outlet for that portion of the cylinder below piston 72.

Cylinder 74 has a dowel pin receiving aperture 94 extending through cylinder barrel 76 and bottom plug 80. A dowel pin 96 has a central portion which is press-fit into dowel pin receiving aperture 94. The opposed ends of dowel pin 96 extend into dowel pin receiving passage 56 in gate member 16, thereby connecting gate member 16 to cylinder 74.

A compression spring 98 biases gate member 16 toward the closed position in the lower portion 32 of the cavity. Spring 98 is positioned in reciprocation bore 60 with its upper end seated against a shoulder 100 and its lower end seated against a retaining ring 102. Retaining ring 102 resides in a slot in the exterior surface of cylinder barrel 76.

Top 20 on its lower surface has a pair of concave downwardly-facing shoulders 104. These shoulders are contoured to receive the upper side of cylindrical peripheral surface 48 of gate member 16 when the gate member is in the open position as shown in phantom in FIG. 1.

In operation, the gate valve shown in FIGS. 1, 2 and 3 is retained in an open position by introduction of a pressurized fluid. The pressurized fluid enters shut-off valve 10 through the passage in top insert 64. The pressurized fluid then travels downwardly through rod 68, out aperture 90, and into the interior of cylinder 74. When gate member 16 is in the closed position as shown in FIG. 2, this pressurized fluid begins to fill the interior of cylinder 74 and acts against the inside surface of cylinder gland 78 to force cylinder 74 upwardly against the biasing force of spring 98. Gate member 16 travels upwardly until it comes to rest in shoulders 104 as shown in phantom in FIG. 1. The gate will be maintained in this open position as long as pressurized fluid is supplied to the interior of cylinder 74 to overcome the biasing force of compression spring 98.

If a shut-down condition occurs in the engine, such as overspeed, an appropriate signal can be transmitted to the pressurized fluid source to vent off the supply of pressurized fluid. When this occurs, compression spring 98 will bias gate member 16 downwardly to the closed position which blocks off air passage 38 shown in FIGS. 1 and 2.

The cylinder, spring and pressurized fluid system described is a fail safe valve design. That is, the valve closes if pressurized fluid is cut off from the valve. It may be appreciated, however, that the present valve design is readily adapted to non-fail safe valves.

As previously stated, gate member 16 is dimensioned somewhat smaller than the internal dimensions of the housing body 18. Cylinder barrel 76 and dowel pin 96 have diameters smaller than bore 54 and passage 56 in which each is respectively positioned by an amount at least as great as the dimensional differences between gate 16 and the interior of the housing. This permits gate member 16 some amount of clearance between its outer surfaces and the interior walls of the housing so that dirt accumulation in the housing and on the gate member surfaces will not hinder smooth reciprocation of the gate from the open to the closed position. Further, because the valve is operable even after some amount of dirt has accumulated, the shut-off valve of the present invention remains essentially maintenance free much longer than conventional engine air intake valves.

The clearances noted above also permit gate member 16 freedom of movement to seat against either first seating surface 40 or second seating surface 42. Assuming first seating surface 40 is on the inlet manifold side of shut-off valve 10 and second seating surface 42 is on the air induction system side, first circular face 44 of the gate will seat against first seating surface 40 during an overspeed condition. This occurs because a pressure difference across valve 10 causes gate member 16 to be forced toward first seating surface 40 when the gate member is in the closed position.

If an intake manifold explosion occurs, gate member 16 is forced by a pressure difference across the valve toward second seating surface 42. Second circular face 46 of the gate seats against the second seating surface.

It has been found that the shut-off valve of the present invention provides protection against both overspeed and intake manifold explosions even though gate member 16 does not seal tightly against the first and second seating surfaces 40, 42. It may be appreciated that to prevent engine overspeed, it is only necessary to cut off the air supply to the engine sufficiently to prevent combustion to the extent that the running friction of the engine is not overcome. Because an absolutely airtight seal is not required, the engine air intake shut-off valve 10 of the present invention does not require an O-ring or other similar gasket to seal around the first and second ports 34, 36 of the air passage.

Likewise, an airtight seal is not required to contain an intake manifold explosion. Gate member 16 seats tightly enough to act as a flame arrestor. That is, the flame produced by an intake manifold explosion cannot pass around the gate because the small space available between the gate and the housing will cause the flame to cool over the distance it must travel around the gate.

Because an airtight seal is not required for proper functioning of the valve, manufacturing costs are greatly reduced. Seating surfaces 40, 42 need not be smooth to provide the required seal. This means that there is no need to machine the inside surfaces of the housing body to create smooth seating surfaces. Adequately smooth surfaces can be obtained by forming the inside of the housing body using a sand-lock core, a method which costs only about one-third the cost of machining. Further, because machining is not required on the inside of the housing body, the body can be cast in one piece. If internal machining were required, larger valve bodies would have to be formed in halves in order to provide access to complete the internal machining.

It has been found that a 1/32 inch clearance "x" completely around gate member 16, i.e., a 1/16 difference between the outer dimensions of the gate member and the internal dimensions of the housing body, provides long maintenance-free operation in spite of dirt accumulation as well as adequate sealing against overspeed and intake manifold explosion conditions. Further, these clearances are currently effective in three-inch diameter as well as five-inch diameter valve sizes. Smaller clearances may be necessary for smaller diameters. Preferably, circular faces 44, 46 and peripheral surface 48 of gate member 16 are machined to obtain these dimensional differences. Even though dirt has accumulated in the valve, the dimensional differences specified do not permit gate member 16 to stand off from either first seating surface 40 or second seating surface 42 an amount which would not provide an adequate restriction of air flow to protect against overspeed or an intake manifold explosion.

The engine air intake shut-off valve of the present invention has performed effectively in a wide variety of internal combustion engines. For example, a shut-off valve of the type described having five-inch diameter port openings provides effective air line closure in Detroit Diesel Models 8V71 and 8V92; in Caterpillar Models D379, D353 TA, and D398; and in Cummins Model V378. A three-inch valve model is effective when installed in a Duetz Model 6L812; in an Onan Model 6DJB; and in Caterpillar Models D3406, D3408, D3412, and D3306.

Figure 4:
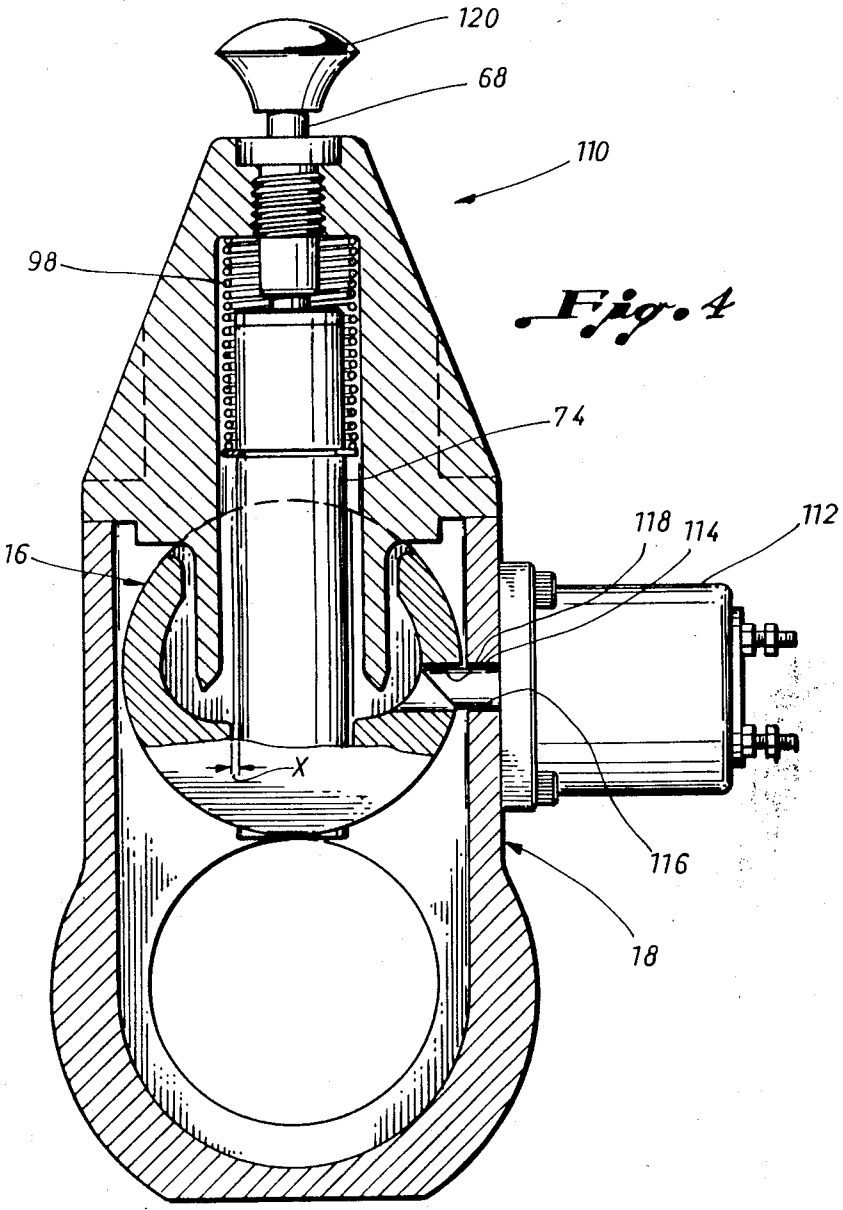
FIG. 4 is a partial vertical section through an alternative embodiment of the shut-off valve of the present invention in which a solenoid and latch combination is used to retain the gate member in the open position.

An alternative of the shut-off valve of the present invention is shown in FIG. 4. Instead of utilizing a pressurized fluid source to hold gate member 16 in an open position, engine air intake shut-off valve 110 has a latching mechanism. The latch may be retracted by any appropriate actuating mechanism, such as a solenoid, a pneumatic system or a hydraulic system. As shown a solenoid 112 is mounted on the exterior of housing body 18 with a reciprocable latch 114 projecting through an aperture 116 in the side of body 18 and an aperture 118 in the side of gate member 16. Unlike the fluid pressure controlled design, rod 68 extends through top insert 64 and is slidingly engaged therein. Preferably, a hand knob 120 is attached to the upper end of rod 68 so that gate member 16 may be manually pulled upwardly against the force of spring 98 into the open position shown in FIG. 4. In the open position, latch 114 projects through aperture 118 to maintain gate 16 in the open position. After the latch has been engaged, rod 68 can be pushed downwardly to be housed in cylinder 74. When solenoid 112 receives an appropriate signal, latch 114 is withdrawn from gate aperture 118, permitting compression spring 98 to bias the gate into the closed position.

The foregoing description has been directed to particular embodiments of the invention in accordance with the requirements of the patent statutes for the purposes of illustration and explanation. It will be apparent, however, to those skilled in this art that many modifications and changes in the apparatus set forth will be possible without departing from the scope and spirit of the invention. It is intended that the following claims be interpreted to embrace all such modifications and changes.

What is claimed is:

1. A shut-off valve for restricting air flow to or from an engine comprising:

a. a housing defining a cavity therein, the cavity comprising an upper portion and a lower portion;

b. an air passage extending through the housing and being alignable with an engine air intake line, the air passage comprising axially aligned first and second ports extending through opposed sides of the housing and also comprising the lower portion of the cavity intermediate the first and second ports;

c. a first seating surface extending around the periphery of the first port and comprising a portion of an interior surface of the housing;

d. a second seating surface extending around the periphery of the second port and comprising a portion of an interior surface of the housing;

e. a gate member residing in the cavity, the gate member being reciprocable in the cavity in a direction perpendicular to the aligned axes of the first and second ports from an open position in the upper portion of the cavity to a closed position intermediate the first and second ports in the lower portion of the cavity, the gate member having a dimension along the axis of the air passage smaller than the axial distance between the first and second seating surfaces, the gate member being seatable directly against the first or second seating surface;

f. means for reciprocating the gate member into and maintaining the gate member in the open or closed position; and g. means for connecting the gate member to the reciprocating and maintaining means permitting the gate member freedom of movement relative to the reciprocating and maintaining means and along the axis of the air passage to the extent of the distance between the first and second seating surfaces.

2. The valve of claim 1 wherein:

a. the first and second ports are circular;

b. the gate member comprises a disc, the disc comprising opposed first and second circular surfaces and a substantially cylindrical peripheral surface, the disc having a radius larger than the radius of the first and second ports, the outer periphery of the first and second circular surfaces being seatable directly against the first and second seating surfaces, respectively.

3. The valve of claim 2 wherein:

a. the housing has a generally semicircular interior lower wall;

b. the housing has a pair of substantially parallel opposed lateral interior walls, the lateral walls extending the length of the cavity from the upper portion to the lower portion, each lateral wall lying in a plane parallel to the axis of the air passage and being integral with the semicircular lower wall, the distance between the lateral walls being greater than the diameter of the gate member;

c. the housing has a pair of substantially parallel opposed transverse interior walls, the transverse walls extending the length of the cavity from the upper portion to the lower portion in a plane transverse to the axis of the air passage, the first and second seating surfaces comprising a portion of the transverse walls adjacent the first and second ports.

4. The valve of claim 1, 2 or 3 wherein the reciprocating and maintaining means comprises:

a. a cylinder depending upwardly in the cavity from the gate member, the cylinder having an apertured upper wall;

b. a hollow rod rigidly depending downwardly into the cavity from an upper wall of the housing and being in communication with an aperture extending through the upper wall, the hollow rod having a lower end slidably extending through the aperture in the upper wall of the cylinder, the lower end having a piston thereon slidably accommodated within the cylinder, the hollow rod having an aperture above and adjacent the piston communicating between the interior of the cylinder and the interior of the hollow rod;

c. spring means for biasing the gate member toward the closed position; and d. means for introducing a fluid under pressure into the cylinder by passing the fluid through the hollow rod whereby the fluid may act against the upper wall of the cylinder to overcome the force of the spring means and move the gate member from the closed to the open position.

5. The valve of claim 4 wherein:

a. the gate member has a cavity extending there through from its upper side to its lower side;

b. a lower end of the cylinder resides in the gate member cavity, the cavity being dimensioned to provide an annular clearance around the cylinder, the annular clearance being at least as great as the clearance between the gate member and the first and second seating surfaces; and c. the connecting means comprises a pin member having a central portion extending transversely through and rigidly connected to the lower end of the cylinder and having opposed end portions each extending into a respective aperture in the gate member, the apertures being dimensioned to provide an annular clearance around the pin member end portions, the annular clearance being at least as great as the clearance between the gate member and the first and second seating surfaces.

6. The valve of claim 1, 2 or 3, wherein the reciprocating and maintaining means comprises:

a. a cylinder depending upwardly in the cavity from the gate member, the cylinder having an apertured upper wall;

b. a rod slidably extending through an aperture in an upper wall of the housing and having a lower end slidably extending through the aperture in the upper wall of the cylinder, the lower end having a piston thereon slidably accommodated within the cylinder, the rod having a handle at an upper end;

c. spring means for biasing the gate member toward the closed position; and d. a latching mechanism comprising a reciprocable latch projecting through an aperture in the housing and an aperture in the gate member when the gate member is in the open position, and means for retracting the latch from the aperture in the gate member whereby the spring means biases the gate member to the closed position when the latch is retracted.

7. The valve of claim 6 wherein:

a. the gate member has a cavity extending therethrough from its upper side to its lower side;

b. a lower end of the cylinder resides in the gate member cavity, the cavity being dimensioned to provide an annular clearance around the cylinder, the annular clearance being at least as great as the clearance between the gate member and the first and second seating surfaces; and c. the connecting means comprises a pin member having a central portion extending transversely through and rigidly connected to the lower end of the cylinder and having opposed end portions each extending into a respective aperture in the gate member, the apertures being dimensioned to provide an annular clearance around the pin member end portion, the annular clearance being at least as great as the clearance between the gate member and the first and second seating surfaces.

* * * * *